US005729921A

United States Patent [19]

Rojas

[11] Patent Number: 5,729,921

[45] Date of Patent: Mar. 24, 1998

[54] BURIAL MARKER AND DISPLAY BOX

[76] Inventor: Joseph L. Rojas, 8081 El Cerrito Ave., Hesperia, Calif. 92345

[21] Appl. No.: 588,265

[22] Filed: Jan. 18, 1996

[51] Int. Cl.[6] ..... G09F 19/00

[52] U.S. Cl. ..... 40/124.5; 27/1; 40/455

[58] Field of Search ..... 40/124.5, 455; 27/1, 35; 52/103, 104, 128, 133; 220/408, 410, 528

[56] References Cited

U.S. PATENT DOCUMENTS

| | | | |
|---|---|---|---|
| 187,526 | 2/1877 | Ettinger . | |
| 267,206 | 11/1882 | Hoopes . | |
| 528,631 | 11/1894 | Green . | |
| 843,314 | 2/1907 | Waters | 52/133 |
| 1,212,519 | 1/1917 | Linquist | 52/133 |
| 1,214,319 | 1/1917 | Kennedy et al. . | |
| 2,385,520 | 9/1945 | Klinzing | 27/1 |
| 2,880,492 | 4/1959 | Johnson | 27/35 |
| 3,966,075 | 6/1976 | Schultz | 220/408 X |
| 4,227,325 | 10/1980 | Whitford . | |
| 4,555,023 | 11/1985 | Sykes et al. . | |
| 4,811,577 | 3/1989 | Webster et al. . | |
| 4,881,637 | 11/1989 | Peters et al. | 206/278 |
| 5,088,167 | 2/1992 | Rahe | 27/1 |
| 5,277,452 | 1/1994 | Skidmore . | |
| 5,349,727 | 9/1994 | Niebergall | 27/1 |
| 5,371,984 | 12/1994 | Taylor et al. . | |
| 5,404,343 | 4/1995 | Boggio . | |

FOREIGN PATENT DOCUMENTS

| | | | |
|---|---|---|---|
| 2263388 | 7/1993 | United Kingdom | 27/1 |

*Primary Examiner*—Brian K. Green
*Attorney, Agent, or Firm*—Cislo & Thomas LLP

[57] ABSTRACT

A burial marker and display box for the preservation of memorabilia and/or ashes of an individual or individuals. An air- and water-tight container that resists the onslaught of the elements carries or holds a second air- and water-tight container that is removable from the first. The first container may be lockable so as to secure the contents therein. The second container is removable from the first container and has a display window that allows visual inspection of the contents therein. The marker box is interred in the ground, much like a headstone, and allows visiting relatives and friends of the deceased to inspect the preserved memorabilia within the container. Ashes of an individual may also be carried by the container. If memorabilia are to be held in the container along with the ashes, a partition may be included to seal the ashes off from the memorabilia. Alternative embodiments allow several cylinder containers to be held in one single burial marker and display box. Audio and/or video recordings may also be permanently carried by the marker box to allow visiting individuals to hear and/or see the memorialized individual or individuals.

1 Claim, 2 Drawing Sheets

BURIAL MARKER AND DISPLAY BOX

BACKGROUND OF THE INVENTION

1. Field of the Invention

This invention relates to burial markers, more particularly a burial marker which contains memorabilia regarding the deceased.

2. Description of the Related Art

Grave markers and memorials are known in the art and have typically taken the form of a marble headstone or the like. The name of the deceased along with vital information such as the dates of birth and death as well as an epitaph are often included on such markers. Other attempts have been made at improving the art of grave markers and memorials and are listed below.

L. Whitford, U.S. Pat. No. 4,227,325

This patent is directed to a grave marker having a means for displaying a photograph. Referring to FIGS. 1 and 2, hollow tubular chamber 14 serves as a housing for a picture 15 to be preserved. Transparent seals 21 made of a material pervious to light are inserted into each end 20, 20A of chamber 14 to prevent moisture, dust, and other foreign matter from entering tubular chamber 14. Opening 18 is located in the wall of chamber 14 in juxtaposition to picture 15 to permit an observer to view the mounted picture 15. By looking through eyepiece 19, an observer may view the picture 15 mounted in tubular chamber 14.

C. T. Green, U.S. Pat. No. 528,631

This patent is directed to a glass receptacle for displaying written or printed memoranda which is to be buried with the deceased. Referring to the drawing, written or printed memoranda is tightly wrapped around tube B. Tube B is then inserted into glass cylinder A, pressing it down until the flanged end of tube B rests firmly against lower cap D. Cap C is then placed over the end of tube B and cylinder A, thus excluding all air from the written or printed matter. The written or printed memoranda can then easily be read through the large cylinder A.

D. J. Sykes, et al., U.S. Pat. No. 4,555,023

This patent is directed to a container for holding a drum. Referring to FIG. 5, container 120 includes case 122, cover 124, and hinge 126, which enables cover 124 to be folded into a sealing position over the opening 128 of case 122. Case 122 has longitudinally extending sidewalls 130, a bottom sidewall 132, and opposite sidewalls 134. A U-shaped recess 136 in each end wall 134 is open toward the opening 128 and includes a support surface 138 having a radius complementary to the radius of journal 18 of drum 10.

J. Ettinger, U.S. Pat. No.

187,526

This patent is directed to a revolving index housed within a transparent box. Referring to the drawing, A represents a box, or case, which is provided on its upper portion with a hinged lid, or cover, B and on its front side, or face, with transparent sliding door D operating in the vertical grooves cut in the edges of the inner faces of the sides E of the box. Upon the inner faces of the sides E are secured blocks F, in which are journalled the ends of axle H, which is provided with the drum, or cylinder, I. To operate the device, it is only necessary to move the lever, or crank handle, P, thereby revolving the drum, or cylinder, I, bringing the desired portion of the drum, or cylinder, before the transparent door.

B. M. Boggio, U.S. Pat. No. 5,404,343

This patent is directed to a resting-place marker having an audio system for playing recorded messages. FIGS. 1–6 show a number of embodiments of a digital audio system used in combination with a resting-place marker. The audio system includes an electrical power supply located at the marker site. The electrical power supply may include a battery 46 and a photovoltaic panel 36 connected to a battery 46. The audio system may also include a manually operable start switch 40 which may include an off mode to stop the broadcast when desired. Other options include a manual volume control and an earphone jack.

As can be seen from the relevant art listed above, several attempts have been made to improve the art of grave markers and memorials. However, a memorial providing a secure and weatherproof container protecting memorabilia regarding the deceased has not been fully achieved.

SUMMARY OF THE INVENTION

The present invention resides in a burial marker and display box meant for interment. The marker box provides a first outer interment container and is constructed of resilient material able to maintain an air- and water-tight chamber to resist the onslaught of the elements. Such material may include polypropylene. In the marker box, a container of a cylindrical or other shape is supported for easy removal from within the marker box and provides a second inner memorabilia vessel. The cylinder is air- and water-tight so as to also resist the onslaught of the elements and to preserve the integrity of the memorabilia or other materials held inside the cylinder. The cylinder may be attached, as by a chain, to the marker box so that permanent removal cannot occur. This provides a measure of security for the perhaps dear contents kept inside the marker box.

The marker box has a cutout section for a lockable lid to secure the contents therein. Alternative embodiments include a single marker box holding several memorial cylinders and the provision of audio and/or video recordings of one or more deceased.

OBJECTS OF THE INVENTION

It is an object of the present invention to provide a burial marker and display box that preserves in good condition and guards against the elements memorabilia regarding a deceased.

It is an additional object of the present invention to provide a container of a cylindrical or other shape that fits within a burial marker and display box and preserves memorializing or other items in good condition, protected from the elements.

It is another object of the present invention to provide a burial marker and display box in combination with a cylinder, both the box and cylinder protecting their contents from the outside elements.

It is yet another object of the present invention to provide a burial marker and display box that can present audio and/or video information of the deceased to those visiting the burial marker and display box.

These and other objects and advantages of the present invention will be apparent from a review of the following specification and accompanying drawings.

DESCRIPTION OF THE PREFERRED EMBODIMENTS

Figure 1:
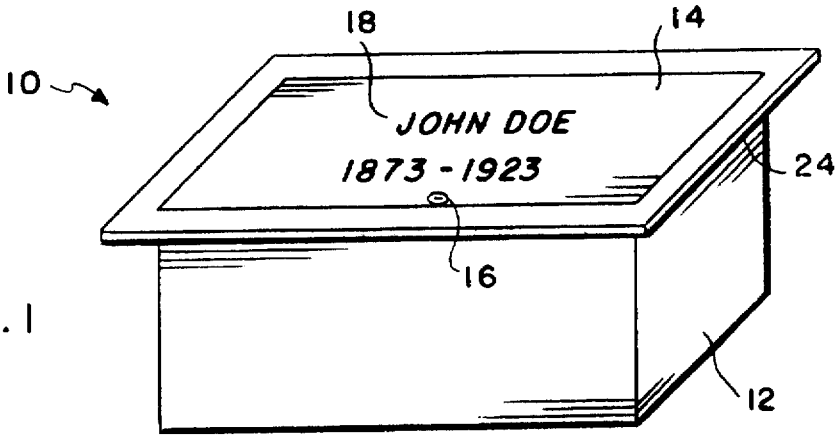
FIG. 1 shows a top perspective view of the burial marker and display box of the present invention in its above-ground, or non-interred, state.

As shown in FIG. 1, the burial marker and display box 10 of the present invention has a box portion 12 and a lid portion 14. The lid portion 14 may be connected to the box portion 12 by means of a living hinge, actual hinge, or otherwise so that the lid 14 may seal the box 12 when the lid 14 is secured to the box 12. Both the lid 14 and the box 12 are made of weather-resistant materials, such as polypropylene. Polypropylene has the additional advantage of being very light and easy to manufacture and mold so that the manufacture of the burial marker and display box of the present invention may be easily and inexpensively achieved.

As shown in FIG. 1, the lid 14 may carry a lock 16 so that the burial marker 10 may be secured in order to prevent unauthorized or uninvited access to the contents of the marker 10. The lid 14 also may bear an inscription 18 indicating the name of the deceased and other vital information. It should be noted that, while the present invention is directed toward a burial marker and display box for a deceased human being, memorialization of animals or organisms may also be achieved by use of the present invention.

Figure 2:
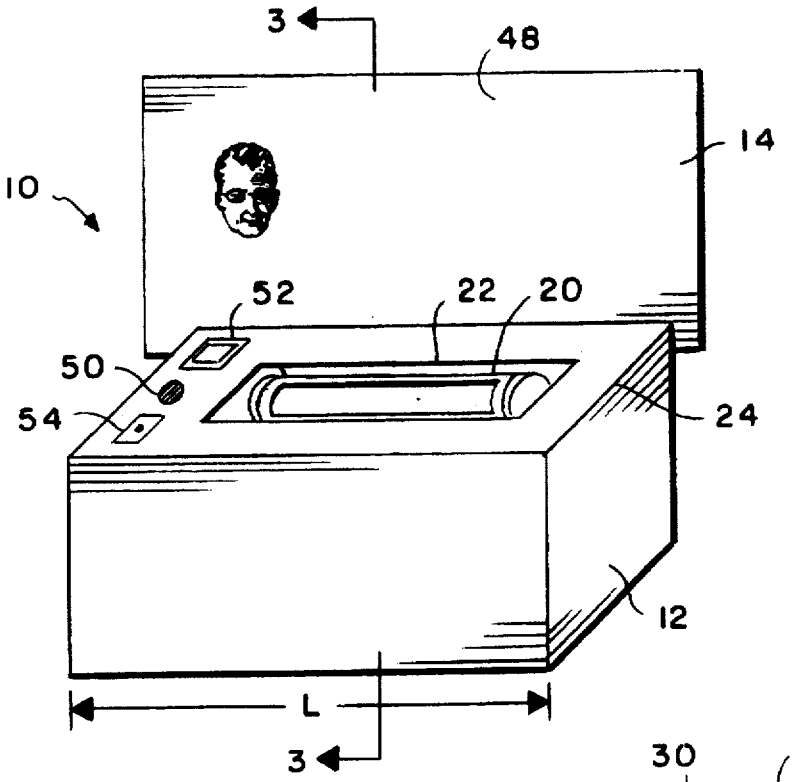
FIG. 2 shows a top perspective view of the burial marker and display box of FIG. 1 with the lid open, showing the cylinder contained therein.

As shown in FIG. 2, the lid 14 swings open after lock 16 is unlatched. Opening of the lid 14 reveals the contents of the box 12 which includes the cylinder 20 within which memorabilia or other materials may be preserved in good condition against the elements.

Figure 3:
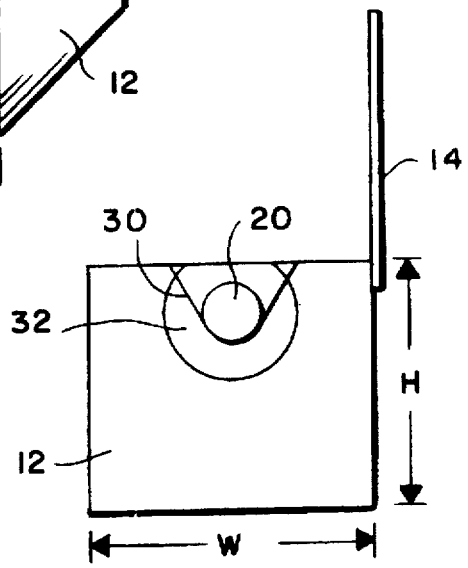
FIG. 3 shows a side cross section view of the burial marker and display box of FIG. 2, taken along line 3—3.

The container 20 may be of a cylindrical or other shape; however, a cylindrical container 20 is believed to be a more desirable shape than any other. The container 20 rests within a cradle or slot 22 within the marker box 10. The cradle 22 provides a stable support for the container 20 and allows the container 20 to rest below the topmost portion 24 of box 12. With the container 20 sunk into the box 12, the lid 14 may completely cover and seal the box 12 without interference from the container 20. As shown in FIG. 3, an alternative embodiment of the cradle 22 allows the container 20 to be supported within the box 12. In FIG. 3, a sling 30 carries the container 20 within a chamber 23 carved out or molded in the box 12. While the sling 30 allows some movement of the container 20 within the chamber 32, the sling 30 may also provide easier access to the container 20 for removal from the chamber 32.

As shown in FIGS. 2 and 3, the dimensions of the box 12 may be on the order of twenty-eight inches (28") in length L, sixteen inches (16") in width W, and eighteen inches (18") in height H.

Figure 4:
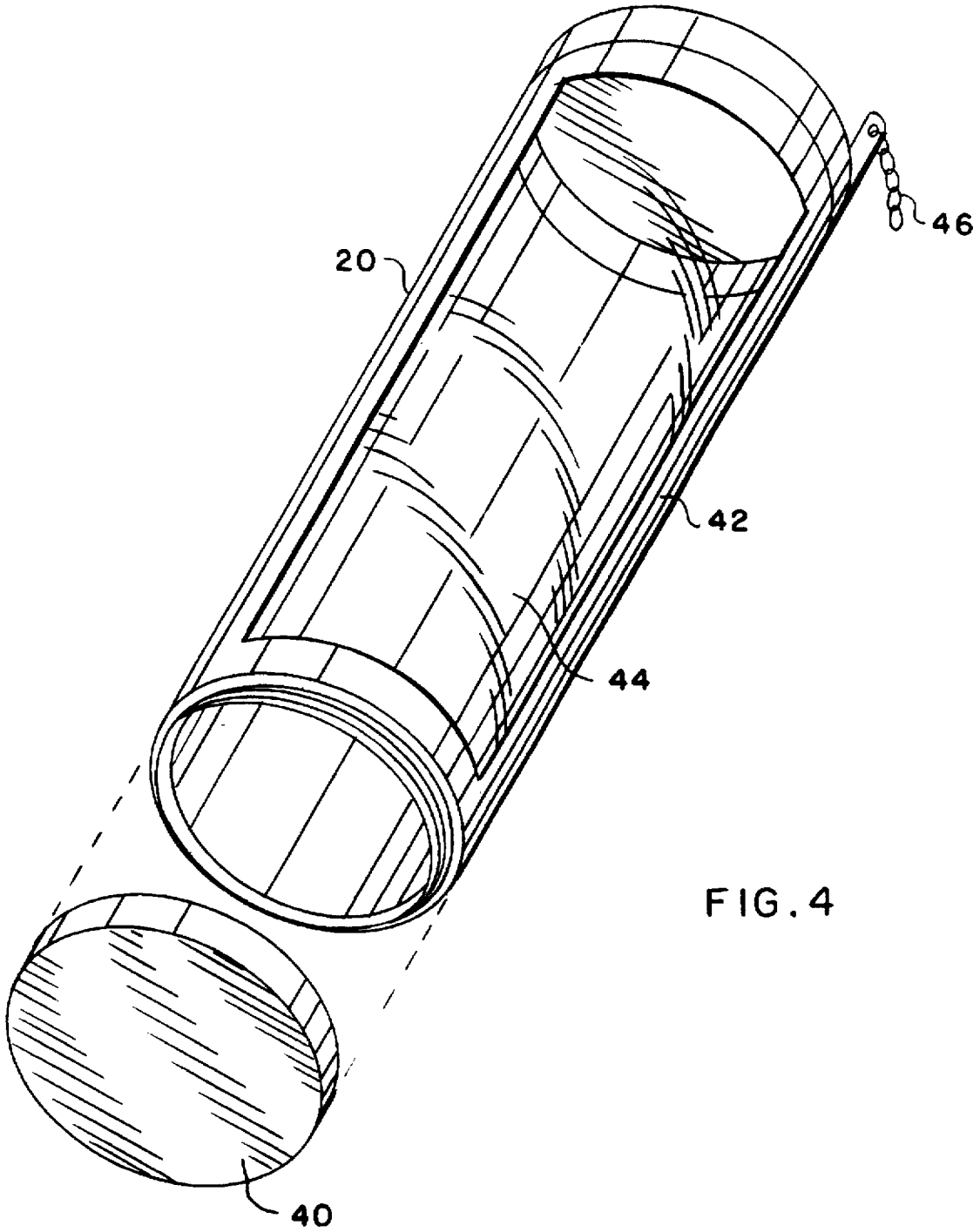
FIG. 4 shows a top perspective view of the cylinder shown in FIGS. 2 and 3.

As mentioned above, the container 20 may take the form of a cylinder but may also take other geometrical shapes according to convenience and preference. The container may have a lid or door that allows access into the hollow interior, or vessel chamber, of the container 20. In the cylindrical embodiment of the container 20, one end of the cylinder may be threadably removable from the main portion of the cylinder (FIG. 4). The door, lid, or cap to the container 20 engages the container so as to provide an airtight and watertight seal. The seal between the door and the main portion of the container 20 serves to protect and preserve the contents of the container 20 from the elements and the accelerated deterioration such elements inflict.

While the cap 40 provides an airtight seal between itself and the main portion 42 of the container 20, means by which such contents may be viewed are achieved by providing a window or other clear partition 44 in the side of the cylinder 20. Such window, or partition, 44 should generally filter out all the visible light so that neither ultraviolet nor infrared light will adversely affect, or damage, the contents of the container 20 when exposed to light as when viewing. The cap 40 may be permanently attached to the main portion of the cylinder 42 or may be removable to allow the insertion or extraction of materials from the container 20. If the cap 40 is removable, it must reestablish the air- and water-tight seal between it and the main portion 42 of the container 20 to preserve the contents of the container 20 in good order.

Contemplated contents to be preserved in good order within the container 20 include pictures, writings, and the like. Such contents may also include the ashes of the deceased. Such ashes may also be kept inside the container along with other memorabilia such as a picture, the ashes kept separate from the memorabilia.

Upon construction of the burial marker and display box 10 of the present invention along with the container 20, the marker box 10 is set into the ground so that the lid 14 is left exposed. The top portion 24 of the box 12 may also be somewhat exposed to prevent adjoining leaves, grass, and dirt from falling into the marker box 10. Before interment, the lid 14 is inscribed with the appropriate indicia 18 pertinent to the box's contents.

The appropriate memorializing memorabilia are then inserted into the container 20. If ashes of a deceased are to be contained in the container 20, they are inserted into the container 20 and then sealed off from any remaining space if memorabilia is also to be held by the container 20. Once the contents to be held by the container 20 are placed therein, the cap 40 may then be threaded upon the opened end of the container 20. Alternatively, if other embodiments are used, whatever door or lid is used to allow access to the interior of the container 20, that door or lid is likewise sealingly attached to the container 20 to preserve the contents. The container 20 may then be attached, as by a chain 46, to the marker box 10 within the confines of the box's interior. The lid 14 is closed, and lock 16 is locked. The keys are delivered to the deceased's family so that only authorized access to the box's contents may be provided. Alternatively, keys may be held centrally by a memorial garden's administration and released only to appropriate individuals.

Over the course of years, the marker box 10 will preserve the container 20 from the onslaught of the elements. Additionally, the container 20 will preserve its contents against any elements it should come into contact with. This provides a double measure by which the contents of the container 20 may be preserved in good order for several generations. When visits are made to the site of the marker box 10, the lid may be unlocked and the memorializing contents of the container be inspected so that individuals may reminisce about the former life of the individual and pay their appropriate respects.

In additional embodiments of the present invention, a single burial marker and display box may carry several cylinders in a manner somewhat akin to a family crypt. Additionally, recorded audio and/or video information of presentation may accompany the marker box 10 so that individuals may actually hear a deceased individual speak and, for video recordings, see a video recording of the individual. As shown in FIG. 2, a loudspeaker 50 and video display 52 provide audio and video playback means by which audio and video recordings may be played back to an audience. An activator switch 54 triggers playback of the recordings for the audience. Additionally, the interior side 48 of lid 14 may have inscribed or otherwise carry a likeness of the individual memorialized by the marker box 10.

While the present invention has been described with regards to particular embodiments, it is recognized that additional variations of the present invention may be devised without departing from the inventive concept.

What I claim is:

1. A burial marker and display box for preserving memorializing memorabilia, comprising:

a generally rectangular box for interment into the ground, said box resisting attack by ambient elements, said box defining a receiving chamber having an open end, said box securing said chamber from adjacent elements;

a lid, said lid covering said box at said open end of said receiving chamber, said lid hingeably attached to said box, said lid being lockable to said box in order to secure contents therein, said lid securely engaging said box to make it weathertight;

a cylindrical member, said cylindrical member engaging and resting in said receiving chamber so as to be contained within said box, said cylindrical member being removable from said box without damaging said box, said cylindrical member defining a hollow chamber capable of containing articles, said cylindrical member also being at least partially transparent to allow inspection of said hollow chamber, a cap, said cap attachably fixed to said cylindrical member to seal said hollow chamber and to protect the confines therein;

a chain, said chain securely attaching said cylindrical member to said box; and said box, said lid, said cylindrical member, and said cap all constructed of durable material capable of withstanding attack by ambient elements; whereby a weatherproof and protected environment is provided for articles, by the burial marker and display box, allowing for preservation and inspection of the articles for several years.

* * * * *